US006243892B1

(12) United States Patent
Kelling

(10) Patent No.: US 6,243,892 B1
(45) **Date of Patent: *Jun. 12, 2001**

(54) SLEEPING APPARATUS

(76) Inventor: Bruce G. Kelling, P.O. Box 1567, Big Timber, MT (US) 59011

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/134,454

(22) Filed: Aug. 14, 1998

(51) Int. Cl.[7] ..... A47G 9/08
(52) U.S. Cl. ..... 5/413 R; 5/417; 5/420
(58) Field of Search ..... 5/413 R, 413 AM, 5/417, 420, 625, 628; 190/2; 343/4; 2/69.5; 224/153, 156, 155, 237, 632

(56) References Cited

U.S. PATENT DOCUMENTS

| | | | | |
|---|---|---|---|---|
| 510,239 | * | 12/1893 | Carr | 5/413 R X |
| 748,288 | * | 12/1903 | Klein | 5/413 R X |
| 2,324,665 | * | 7/1943 | Ayres | 5/413 R |
| 2,428,795 | * | 10/1947 | Frazee | 224/153 |
| 3,828,992 | | 8/1974 | Cerhione | 224/9 |
| 3,902,640 | | 9/1975 | Geiben | 224/8 |
| 3,986,505 | * | 10/1976 | Power | 5/625 X |
| 4,103,377 | | 8/1978 | Mayer et al. | 5/343 |
| 4,466,124 | | 8/1984 | Kirkham, Jr. | 383/2 |
| 4,538,750 | | 9/1985 | Hanna | 224/156 |
| 4,604,765 | * | 8/1986 | Schultz | 5/413 AM |
| 4,757,832 | * | 7/1988 | Russell | 5/413 R X |
| 4,884,731 | | 12/1989 | Sibley | 224/215 |
| 4,901,897 | | 2/1990 | Briggs et al. | 224/153 |
| 4,923,104 | * | 5/1990 | Rice et al. | 224/155 |
| 5,044,031 | * | 9/1991 | Sherwood et al. | 5/625 X |
| 5,404,600 | * | 4/1995 | Demars | 5/420 X |
| 5,458,278 | | 10/1995 | LaConte | 224/209 |
| 5,531,366 | | 7/1996 | Storm | 224/153 |
| 5,590,825 | | 1/1997 | Murdock | 224/156 |
| 5,622,300 | | 4/1997 | Robinson | 224/575 |
| 5,628,443 | | 5/1997 | Deutsch | 224/583 |
| 5,699,568 | * | 12/1997 | Couldridge | 5/625 X |

* cited by examiner

*Primary Examiner*—Lynne H. Browne
*Assistant Examiner*—Fredrick Conely
(74) *Attorney, Agent, or Firm*—Daniel A. Thomson; Roger D. Emerson; Emerson & Skeriotis

(57) ABSTRACT

A sleeping apparatus includes a sleeping bag and a pad. The sleeping bag has front and back sides and is selectively convertible between an unfolded sleeping configuration and a folded backpack configuration. The pad is operatively attached to the back side of the sleeping bag and is also selectively convertible between an unfolded sleeping configuration and a folded backpack configuration. The pad serves as padding for the sleeping bag when both are in the sleeping configuration. The pad also serves as a backpack shell for holding the sleeping bag and any other contents within when both are in the backpack configuration. Thus, the pad provides structural strength to the backpack. To convert the sleeping apparatus from the sleeping configuration to the backpack configuration, the sleeping bag is folded into the backpack configuration. Next, the pad is folded into the backpack configuration around the folded sleeping bag. Finally, the pad is secured into the folded backpack configuration by securing means such as connectable straps.

7 Claims, 9 Drawing Sheets

SLEEPING APPARATUS

BACKGROUND OF THE INVENTION

1. Field of Invention

This invention pertains to the art of methods and apparatuses for use in sleeping, and more specifically to methods and apparatuses for a sleeping apparatus that is convertible between a sleeping configuration and a backpack configuration.

2. Description of the Related Art

Sleeping bags are well known in the art. Typically, sleeping bags are folded or rolled up and then fastened into the rolled up condition when not being used to sleep in. Such known sleeping bags are generally effective for sleeping purposes but are difficult to carry. It is also known to use a pad with a sleeping bag. Typically, such pads are effective but they become just one more individual component for the user to carry. Thus, sleeping bags individually or with separate pads are generally cumbersome to transport. What is needed is a sleeping apparatus that combines a pad and a sleeping bag into an integral unit that can be converted into a backpack for easy and light portability.

DeMars, in U.S. Pat. No. 5,404,600, discloses a combination sleeping/carry bag. However, DeMars provides very little protection for the sleeping bag while it is being carried from one place to another. When sleeping bags are transported outside they are exposed to various weather conditions including wind, rain, snow and the like. In addition, side shoulder straps, such as provided by DeMars, can easily slide off of a walking user's shoulder. Thus, side shoulder straps are not conducive to travelers, such as many hikers/campers, who travel relatively long distances while carrying their sleeping bag. What is needed is a sleeping apparatus that can easily be carried long distances and that is well protected from the elements.

It is also known in the art to combine bed frames and/or cots with backpacks. Murdock, for example, in U.S. Pat. No. 5,590,825 discloses a backpack with a convertible frame. Such bed frames are believed to be effective for their intended use and are more conducive to carry long distances. However, such bed frames are heavy and thus require a relatively high level of fitness for users who carry them long distances. In addition, such bed frames require complex folding and unfolding when used. What is needed is a frameless sleeping apparatus that is light to carry and easy to fold and unfold.

In U.S. Pat. No. 4,466,124, Kirkham, Jr. discloses a backpack and sleeping bag system. However, the sleeping bag is a separate item that is attached to the backpack. Also, as is common in the art, Kirkham Jr.'s system includes a frame and numerous pockets for holding various items. This greatly increases the weight of the system. What is need is a backpack that is convertible into a sleeping bag and yet is readily able to transport other articles such as clothing, cameras, toiletries, etc. In this way, travel can be simplified and light traveling can be encouraged.

The present invention provides a sleeping apparatus that is easily converted between a lightweight backpack and a sleeping bag with a pad. Thus, the difficulties inherent in the prior art are overcome in a way that is simple and efficient, while providing better and more advantageous overall results.

SUMMARY OF THE INVENTION

According to one aspect of the present invention, there is provided a sleeping apparatus that includes a sleeping bag and a pad. The sleeping bag has front and back sides and is selectively convertible between an unfolded sleeping configuration and a folded backpack configuration. The pad is operatively attached to the back side of the sleeping bag and is also selectively convertible between an unfolded sleeping configuration and a folded backpack configuration. The pad serves as padding for the sleeping bag when both are in the sleeping configuration. The pad also serves as a backpack shell for holding the sleeping bag within when both are in the backpack configuration. When in the backpack configuration, the pad provides structural integrity for the backpack.

According to another aspect of the present invention, there is provided a method of converting the sleeping apparatus from the sleeping configuration to the backpack configuration. The method includes the following steps. First, the sleeping bag is folded into the backpack configuration. Next, the pad is folded into the backpack configuration around the folded sleeping bag. Thus, the pad forms a backpack shell that holds the folded sleeping bag within and protects and secures any other contents. Finally, the pad is secured into the folded backpack configuration by means such as connectable straps.

One advantage of the present invention is that the sleeping bag and pad form a single unit that is easily convertible between a backpack and a sleeping bag and yet provides room for additional items to be carried by the user.

Another advantage of the present invention is that the pad has dual purposes. When in the sleeping configuration, the pad serves as padding under the sleeping bag, thereby providing comfort for the sleeper. When in the backpack configuration, on the other hand, the pad serves as a backpack shell that holds and protects the folded sleeping bag and any other items stored within the shell. In this way the pad provides the required structural support for the backpack.

Another advantage of the present invention is that the sleeping apparatus is lightweight and easy to carry, even for long distances, because it reduces the amount of extra materials required when a pad, backpack, and sleeping bag are carried separately.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

Figure 1:
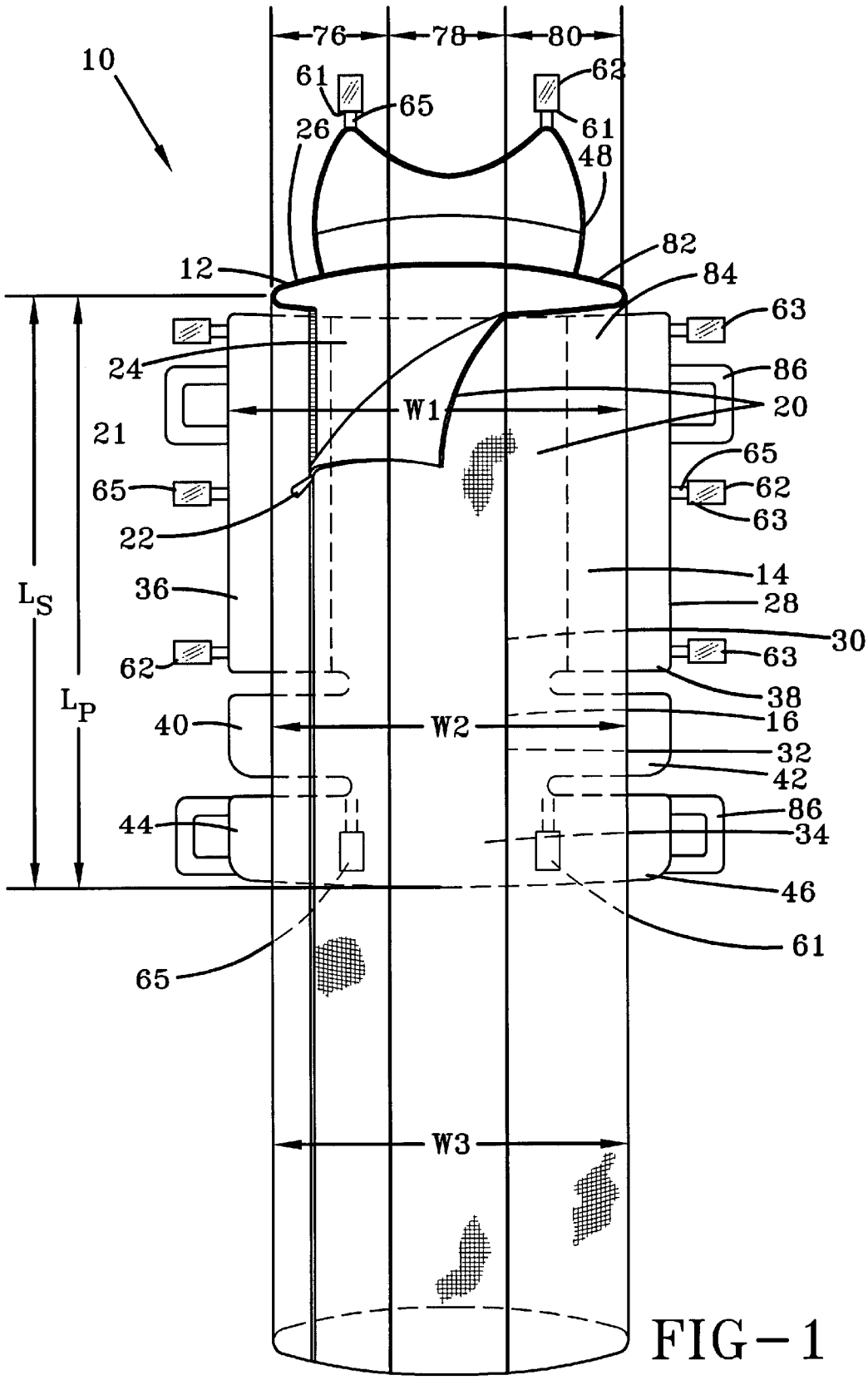
FIG. 1 is a plan view of the inventive sleeping apparatus shown in the unfolded sleeping configuration.
Figure 7:
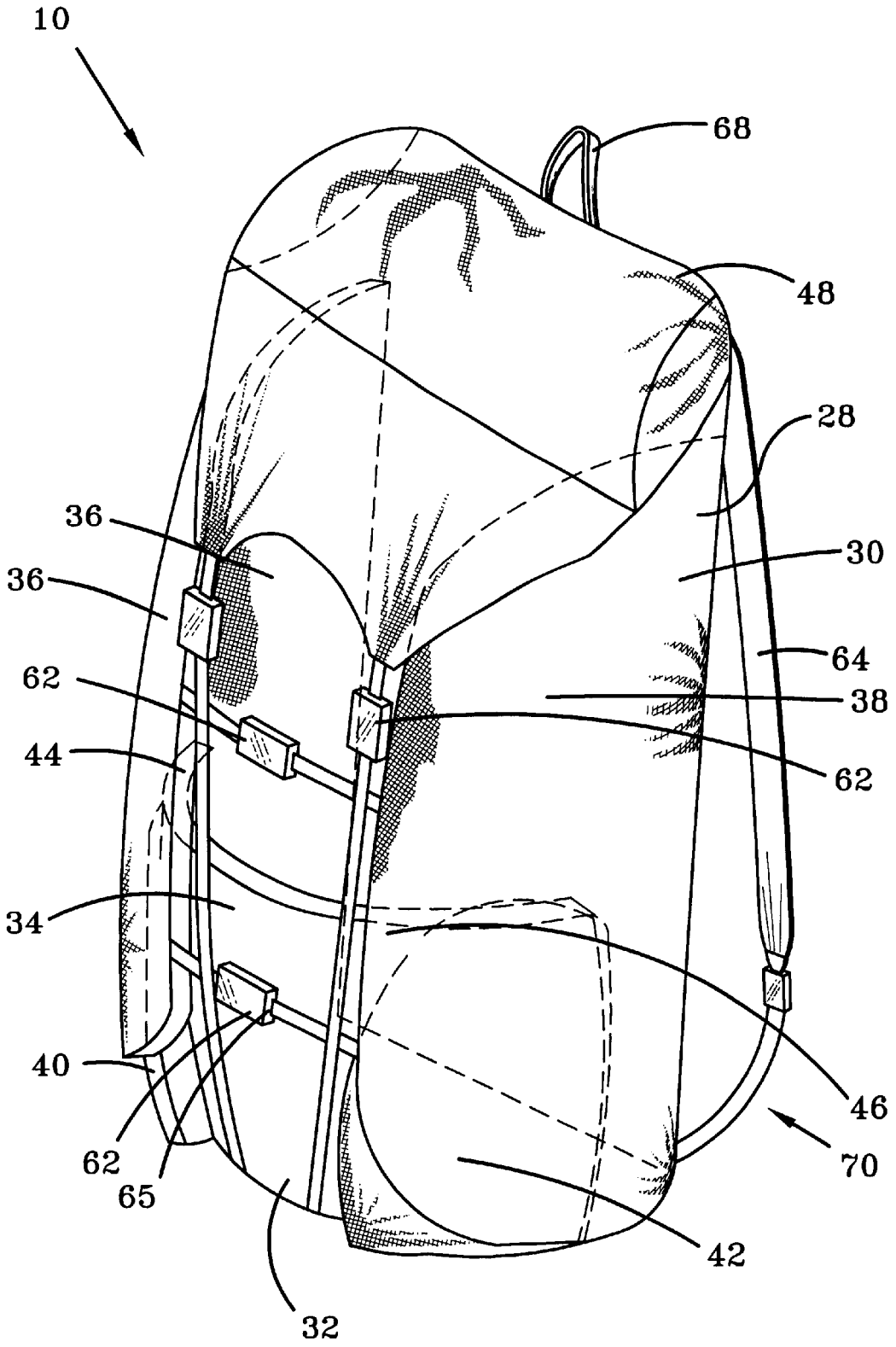
FIG. 7 is a perspective view of the inventive sleeping apparatus shown in the folded backpack configuration.

Referring now to the drawings wherein the showings are for purposes of illustrating a preferred embodiment of the invention only and not for purposes of limiting the same, a sleeping apparatus 10 is selectively convertible between an unfolded sleeping configuration, as shown in FIG. 1, and a folded backpack configuration, as shown in FIG. 7. The primary components of the sleeping apparatus 10 are a sleeping bag 12 and a pad 28. Both the sleeping bag 12 and the pad 28 are selectively convertible between sleeping and backpack configurations as shown in FIGS. 1 and 7.

With reference now to FIG. 1, the sleeping bag 12 has front and back sides 20, 26 and is preferably formed of a fabric material such as nylon. Preferably, the sleeping bag 12 has opening means 21, such as a zipper 22, for opening the sleeping bag 12 and thus providing easy access for a user to enter and exit the sleeping bag 12. It should be noted that the opening means 21, shown on the left side of the sleeping bag as shown in FIG. 1, could be positioned at any desired location on the sleeping bag 12 such as on the right side or in the middle. It should also be noted that snap connectors, hook and loop connectors or any other similar opening means 21 are equally well used with this invention. The sleeping bag 12 can also be used to store various materials such as clothing, cameras, toiletries, and the like when the sleeping bag 12 is in the backpack configuration. The back side 26 of the sleeping bag 12 is operatively attached to the pad 28. Preferably, the sleeping bag 12 is sewn to the pad 28 but other attaching means, such as using snap connectors or hook and loop connectors may also be used.

Still referring to FIG. 1, the sleeping bag 12, in the unfolded sleeping configuration as shown, has top, middle and bottom portions 14, 16, 18 and first, middle and second width zones 76, 78, 80. It should be noted that a user's head (not shown) would extend out of the top portion 14 of the sleeping bag 12 while a user's feet (not shown) would extend within the bottom portion 18. The top, middle and bottom portions 14, 16, 18 have widths W1, W2, W3 respectively as shown. In one embodiment, shown in FIG. 1, the widths W1, W2, W3 are substantially equal, providing a generally rectangular shape for the sleeping bag 12. Alternately, and preferably, width W1 is greater than width W2 and width W2 is greater than width W3 with these widths changing gradually. This provides for a sleeping bag 12 having a "mummy bag" shape as is commonly known in the art of sleeping bags. Preferably, when in the mummy bag shape, the bottom half 82 of the sleeping bag 12 extends upward beyond the top half 84 (as seen in FIG. 1) thereby providing additional cushioning for the head of the user. This is especially useful for cold temperature applications as it provides a tighter fit for the users head. The portions 14, 16, 18 and width zones 76, 78, 80 are used to explain the folding of the sleeping bag 12 as disclosed below.

With continuing reference to FIG. 1, a liner 24, such as a fleece liner or a liner formed of another insulated material, may be inserted inside the sleeping bag 12 to provide insulation and comfort for the sleeper. Preferably, the liner 24 can be easily attached to and removed from the sleeping bag 12. Thus, it is preferred that the liner 24 be connected to the sleeping bag 12 using hook and loop connectors (preferred), snap connectors, zippers, buttons, buckles, ties and/or any other similar means. It is here contemplated that the liner 24 may be interchanged with or added to other liners having desired characteristics. The liner characteristics may include variations based on texture, color, design, insulating factor, thickness, softness and the like. It is also here contemplated that supplemental liners (not shown) may be added under the liner 24 to adjust for temperature changes. Supplemental half liners (not shown) may also be used since the additional insulation is more needful above the sleeper than below the sleeper. Safety features may also be incorporated into the liner. For example, the liner 24 may be colored a fluorescent hunter orange and may contain the letters "SOS". The liner 24 could then be removed from the sleeping bag 12 and displayed for easy viewing by rescue personnel in case of an emergency.

Figure 2:
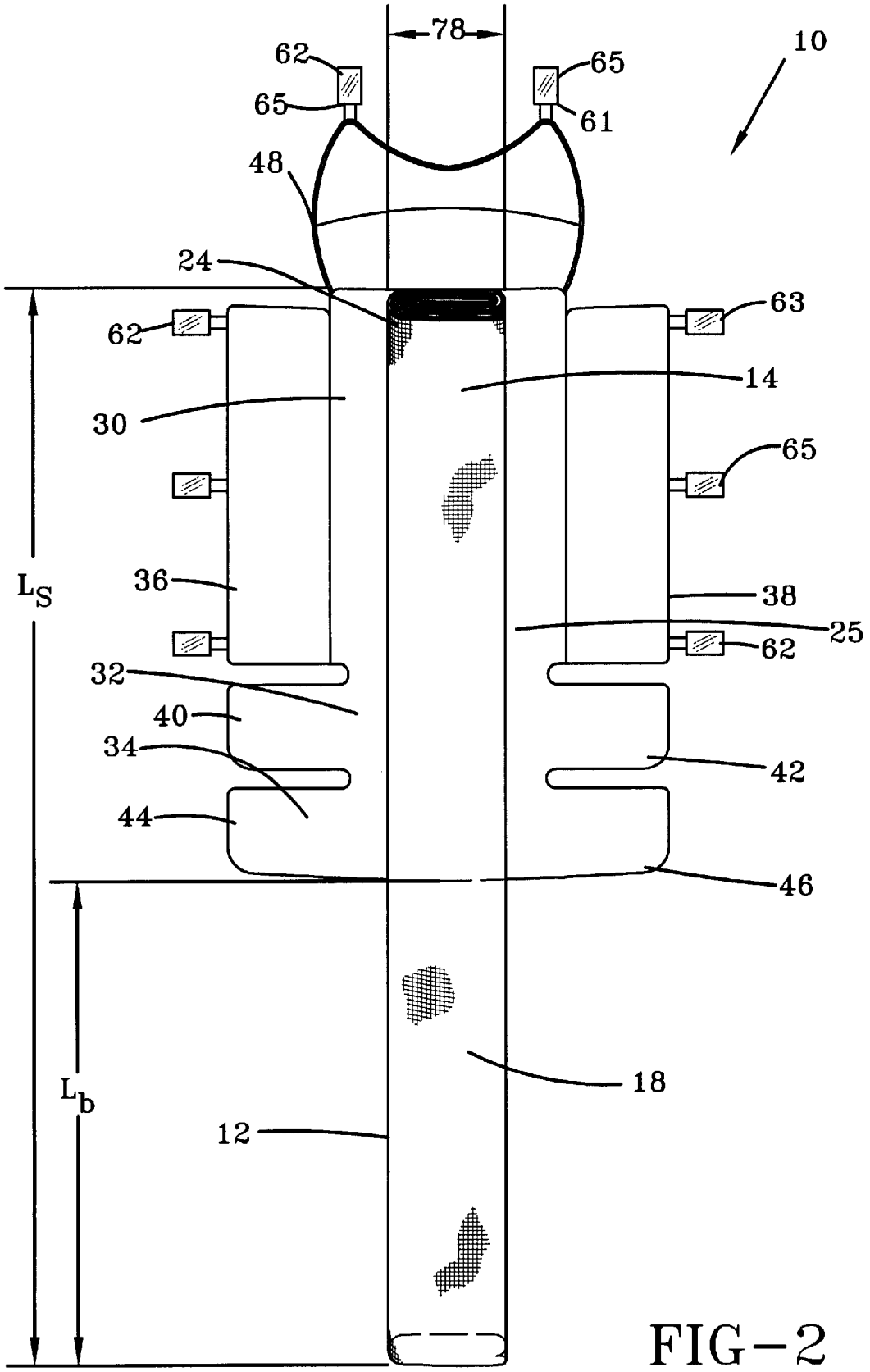
FIG. 2 is a plan view of the inventive sleeping apparatus showing the pad in the unfolded sleeping configuration and the sleeping bag partially folded.
Figure 3:
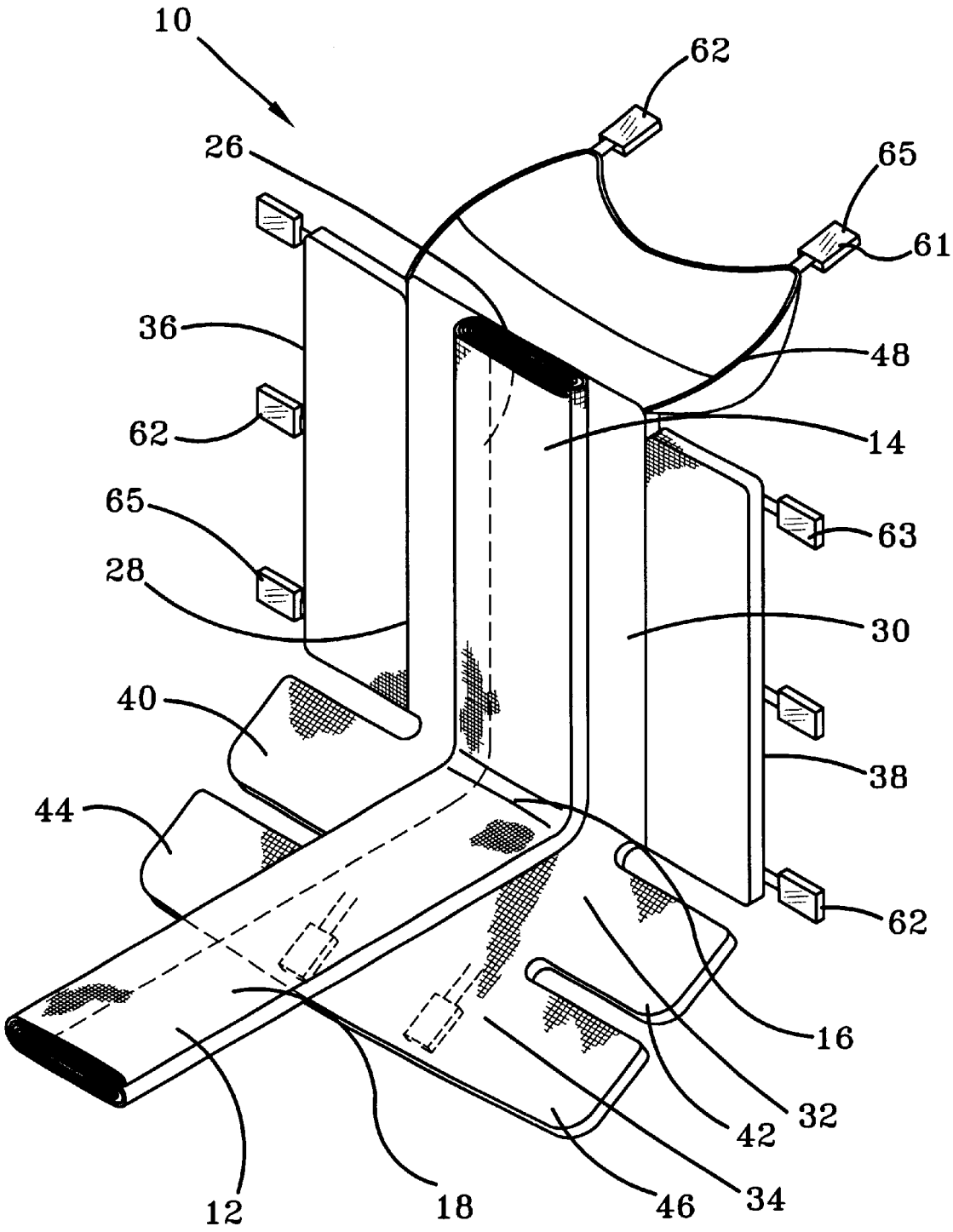
FIG. 3 is a perspective view of the inventive sleeping apparatus showing the pad and the sleeping bag partially folded.
Figure 4:
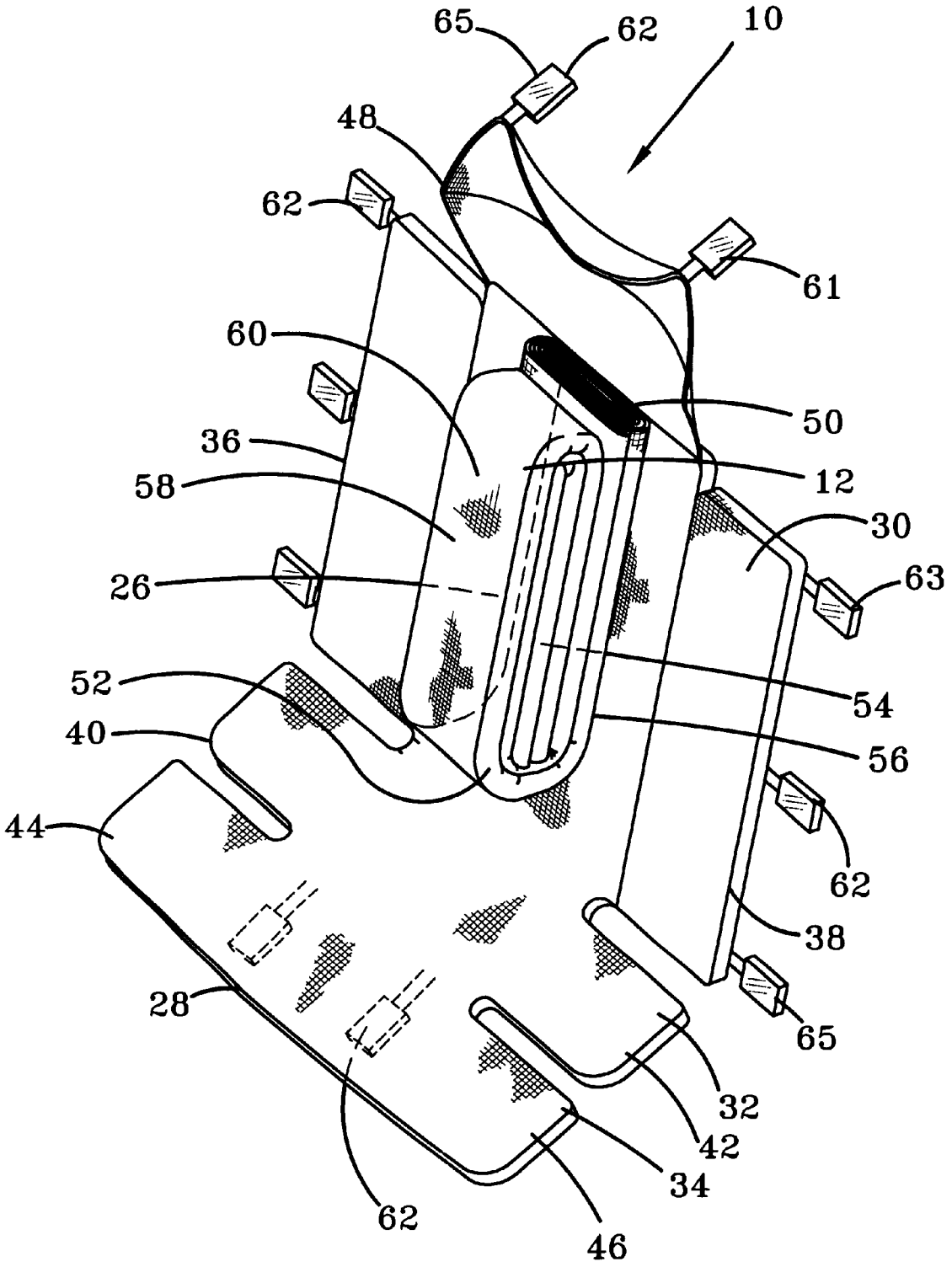
FIG. 4 is a perspective view of the inventive sleeping apparatus showing the sleeping bag in the fully folded backpack configuration and the pad in the unfolded sleeping configuration with the middle and bottom portions of the sleeping bag shown unattached to the pad to better show the shape of the folded sleeping bag.

With reference now to FIGS. 1–2 and 4, the pad 28 may be formed with a flexible cushion encased in a fabric outer layer. Alternately, the pad may be formed of foam or may be an inflatable air mattress such as a Therm A Rest® pad. Of course, other forms of padding are also useful with this invention. Preferably the pad 28 has a generally planar shape when in the sleeping configuration, shown in FIGS. 1 and 2, and includes upper, middle and lower sections 30, 32, 34 each having first, second, third, fourth, fifth, and sixth flaps 36, 38, 40, 42, 44, 46 respectively as shown. The upper, middle, and lower sections 30, 32, 34 have first, second, and third lengths, respectively (shown, but not referenced). In this embodiment, the first length is at least twice the second and third lengths, since the upper section 30 serves as the main body portion of a backpack shell 70. The sleeping bag 12 has a length Ls and the pad 28 has a length Lp. The pad length Lp may be greater than, less than or equal to the sleeping bag length Ls as desired. As shown in FIG. 1, however, the length Ls of the sleeping bag 12 is preferably greater than the length Lp of the pad 28. In particular, it should be noted that the pad 28 does not extend the full length of the bottom portion 18 of the sleeping bag 12. This does not significantly reduce the comfort for a user since a user's lower legs and feet do not require padding as readily as does the user's torso. The lengths Ls and Lp form a length ratio Lp/Ls that is preferably not more than 0.80. This length ratio reduces the overall weight of the sleeping apparatus 10 and provides the appropriate amount of pad 28 material to properly form the later to be described backpack shell 70.

With reference now to FIGS. 1–2 and 7, as noted above, the back side 26 of the sleeping bag 12 is operatively attached to the pad 28. Preferably, the middle width zone 78 of the sleeping bag 12 is sewn to all three of the upper, middle and lower sections 30, 32, 34 of the pad 28 but not to the first, second, third, fourth, fifth, and sixth flaps 36, 38, 40, 42, 44, 46. The first and second width zones 76, 80 of the sleeping bag 12 are not sewn to any portion of the pad 28. This attachment of the sleeping bag 12 to the pad 28 aids in the folding of both the sleeping bag 12 and the pad 28 as will be discussed further below. It is also important to note that the pad 28 has two primary purposes. When in the sleeping configuration, shown in FIG. 1, the pad 28 serves as padding under the sleeping bag 12, thereby providing comfort for the sleeper. When in the backpack configuration, shown in FIG. 7 on the other hand, the pad 28 serves as a backpack shell 70 that holds and protects the folded sleeping bag 12 as well as any materials that may be stored within the sleeping bag 12. In this way the pad 28 provides structural strength to the backpack.

With reference now to FIG. 1, it should also be noted that additional uses for the pad 28 are also here contemplated. For example, optional handles 86 may be added to the flaps of the pad 28 thereby making the sleeping apparatus 10 usable as a rescue stretcher for carrying injured persons or animals to safety.

Figure 8:
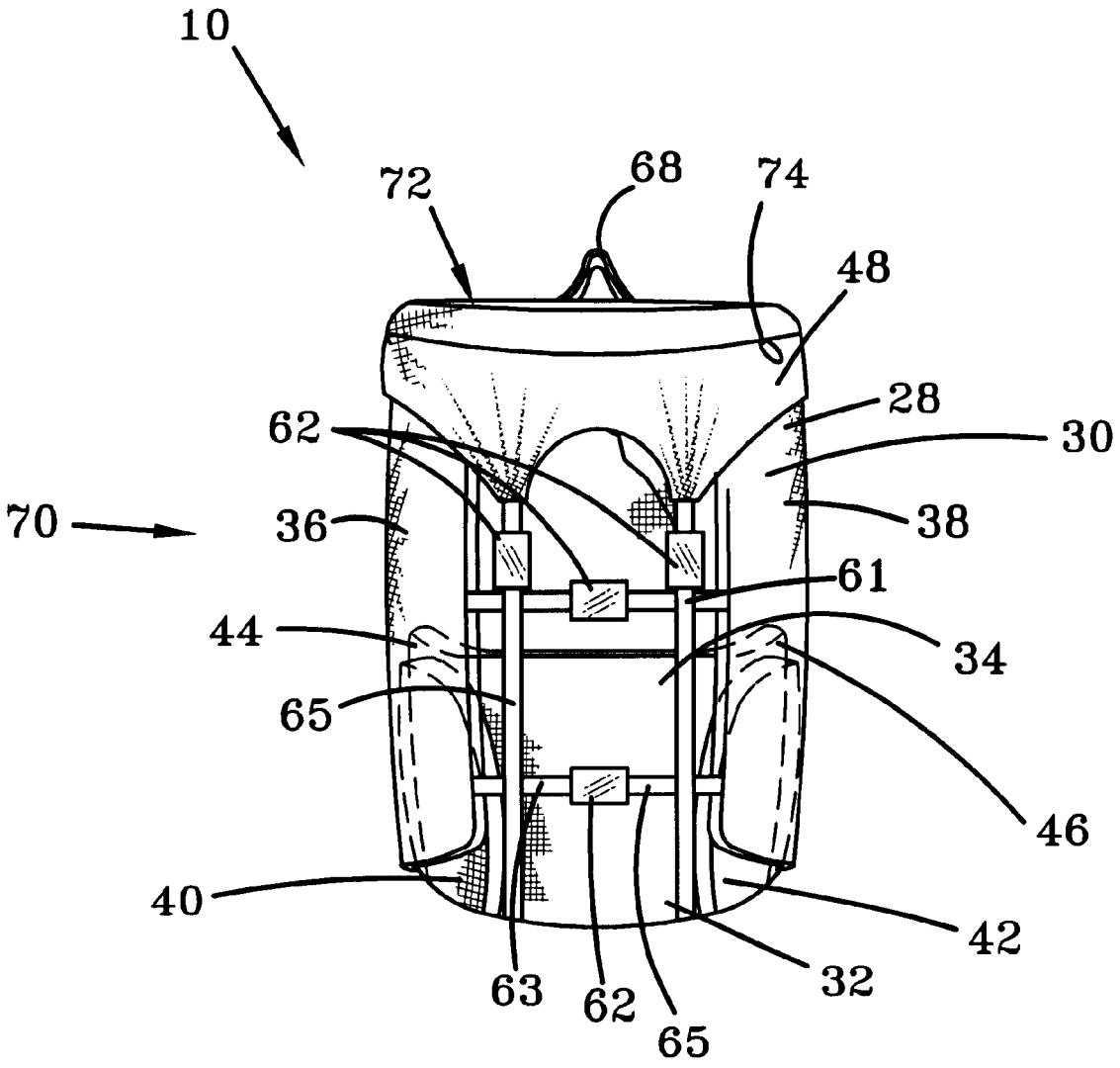
FIG. 8 is a back view of the inventive sleeping apparatus shown in the folded backpack configuration.

With reference now to FIGS. 1 and 7–8, the sleeping apparatus 10 preferably also includes a lid section 48 operatively attached, preferably sewn, to the upper section 30 of the pad 28. This lid section 48 is located in the area of the user's head and can provide a pillow for the user by stuffing the lid 48 with soft materials such as clothing. The lid section 48 also forms a portion of the backpack shell 70 for the sleeping bag 12 when the sleeping apparatus 10 is fully in the backpack configuration. Preferably, the lid section 48 is formed of fabric sheet material and has a compartment 72 accessible by opening means 74 for storing materials, such as clothing, food, etc., within the lid section 48. The opening means 74 can be of any type chosen with sound engineering judgment such as a zipper shown in FIG. 8.

Figure 5:
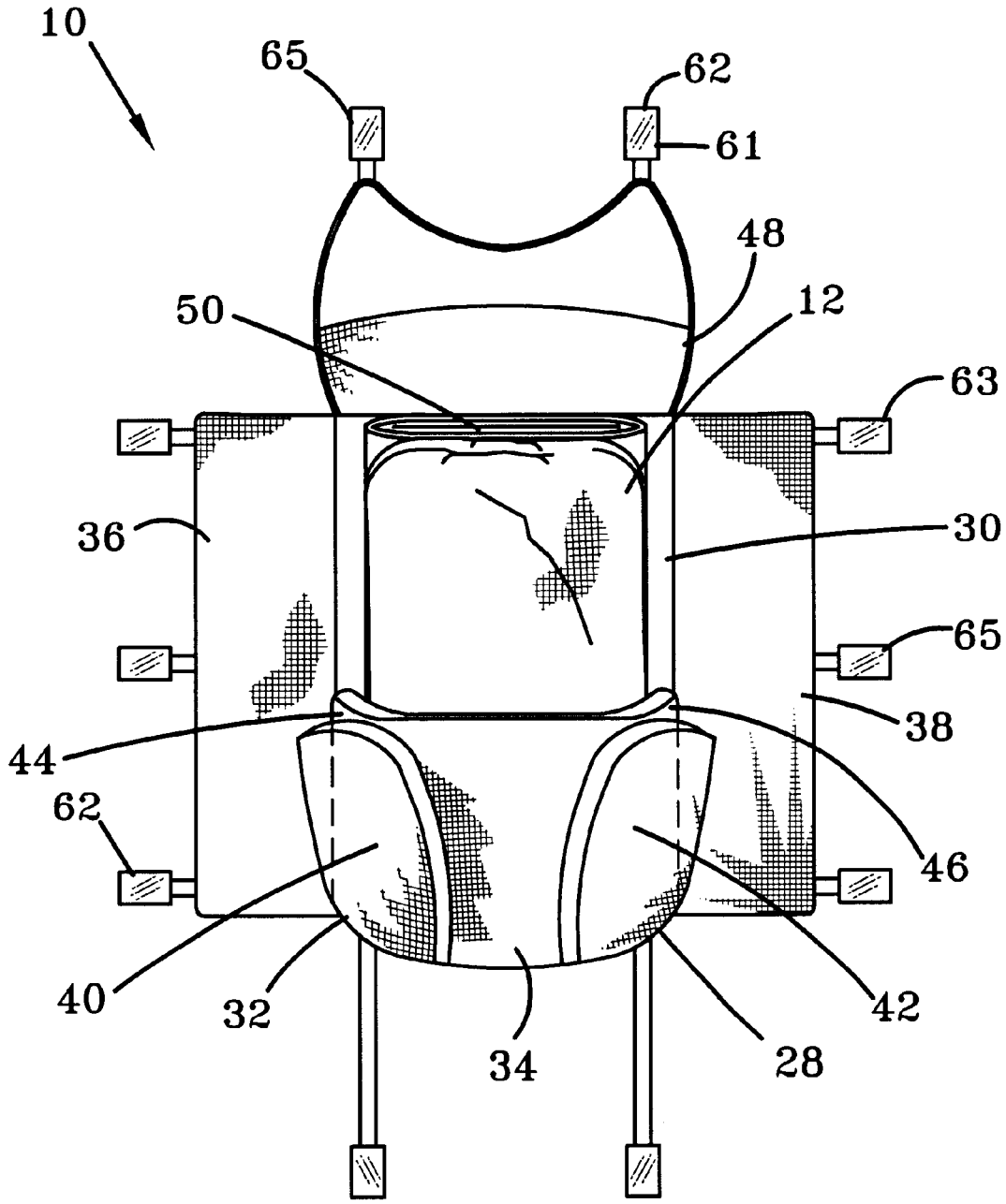
FIG. 5 is a back view of the inventive sleeping apparatus showing the lid and upper sections in the unfolded configuration and the sleeping bag in the folded backpack configuration.

With reference now to FIGS. 4–5 and 7, it should be noted that FIG. 4 does not show the middle and bottom portions 16, 18 of the sleeping bag 12 attached to the pad 28, as is preferred, in order to better show the shape of the folded sleeping bag 12. Once the sleeping bag 12 has been folded into the backpack configuration, the sleeping bag 12 forms a box-like structure having first and second ends 50, 52 and a plurality of sides that preferably comprise first, second, third and forth sides 58, 54, 56, 60. When the pad 28 is folded into the backpack configuration, the pad 28 forms the backpack shell 70 that the folded sleeping bag 12 fits within. Preferably, the backpack shell 70 provides room for not only the sleeping bag 12 but also additional items such as clothing, toiletries, food items, and the like. In this way the sleeping bag 12 as well as any other items stored within the sleeping bag 12 are well protected by the pad 28 from soiling and weather elements such as wind, rain, snow and the like. The backpack shell 70, formed of the pad 28, also provides the basic backpack shape and the required structural rigidity for the sleeping apparatus 10 and contents within.

Figure 6:
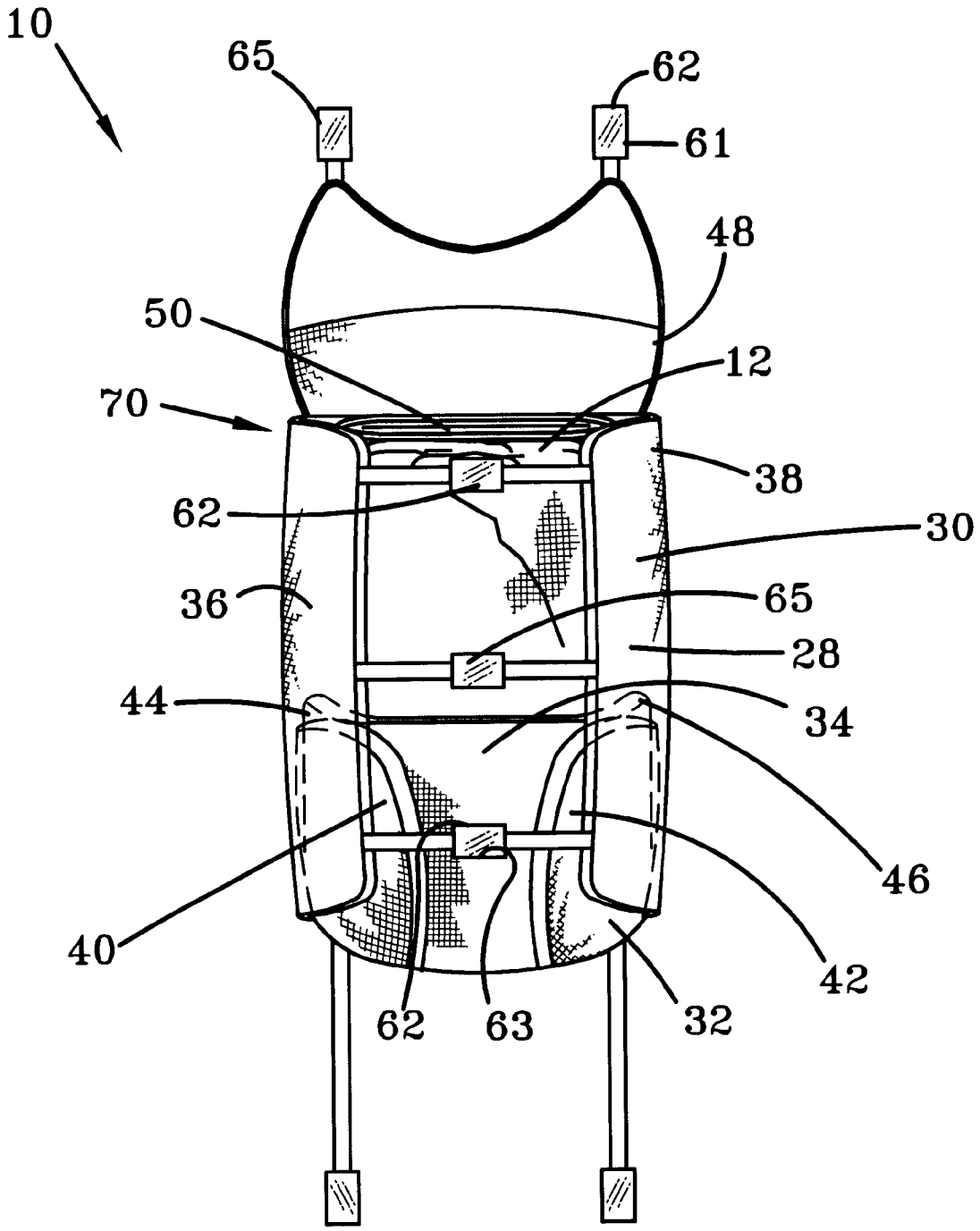
FIG. 6 is a back view of the inventive sleeping apparatus showing the sleeping bag in the folded backpack configuration and the lid section in the unfolded configuration.

With reference now to FIGS. 1–3 and 5–7, the particular arrangement of the pad 28 as it takes the shape of the backpack shell 70 will now be discussed. As noted above and shown in FIG. 5, the sleeping bag 12 is sewn to all three of the upper, middle and lower sections 30, 32, 34 of the pad 28. As shown in FIGS. 5–7, when both the sleeping bag 12 and the pad 28 are folded into the backpack configuration, the pad 28 covers at least a portion of each of the sides 58, 54, 56, 60 of the sleeping bag 12 as well as at least the second end 52. When the pad 28 includes the lid section 48, the lid section 48 and thus the pad 28 also covers at least a portion of the first end 50 of the sleeping bag. This ensures that the sleeping bag 12 and its contents are well protected by the backpack shell 70.

With continuing reference to FIGS. 1–3 and 5–7, when both the sleeping bag 12 and the pad 28 are in the backpack configuration, the upper section 30 of the pad 28 covers at least a portion of the first, second and third sides 58, 54, 56 of the sleeping bag 12. Similarly, the middle section 32 of the pad 28 covers at least a portion of the second end 52 of the sleeping bag 12 and the lower section 34 covers at least a portion of the first, third and forth sides 58, 56, 60. To firmly secure the folded sleeping bag 12 within the backpack shell 70 and to simplify the folding process discussed below, it is preferred that the fifth and sixth flaps 44, 46 of the lower section 34 cover at least a portion of the first and third sides 58, 56, respectively, of the sleeping bag 12. Similarly, it is preferred that the third and fourth flaps 40, 42 of the middle section 32 of the pad 28 cover at least a portion of the first and third sides 58, 56 of the sleeping bag 12, respectively. It should be noted that with this arrangement the third and fourth flaps 40, 42 of the middle section 32 cover at least a portion of the fifth and sixth flaps 44, 46 of the lower section 34. Alternately, the fifth and sixth flaps 44, 46 of the lower section 34 can be folded to cover the third and fourth flaps 40, 42 of the middle section 32. Most preferably, the first and second flaps 36, 38 of the upper section 30 cover at least a portion of the first and third sides 58, 56, respectively, of the sleeping bag 12. It should be noted that with this arrangement the first and second flaps 36, 38 of the upper section 30 also cover at least a portion of the third and fourth flaps 40, 42 of the middle section 32 and at least a portion of the fifth and sixth flaps 44, 46 of the lower section 34. This series of overlapping flaps provides for a safely protected sleeping bag 12, a firmly developed backpack shell 70 and an easily folded sleeping apparatus 10. This also prevents any items, such as a camera, clothes, food items, etc. stored within the sleeping bag 12 and/or the pad 28 from falling out of the backpack shell 70.

With reference now to FIGS. 1 and 6–9, the sleeping apparatus 10 may include securing means 62 for securing the pad 28 into the folded backpack configuration, as shown in FIG. 7. The securing means 62 preferably includes a first securing segment 61 that secures the pad 28 around the folded sleeping bag 12 from the first end 50 to the second end 52. In other words, the first securing segment 61 secures the pad 28 in an end to end direction. It is also preferred that the securing means 62 preferably includes a second securing segment 63 that secures the pad 28 around the folded sleeping bag 12 from side to side. Thus, the first and second securing segments 61, 63 are at right angles with respect to each other, thereby firmly securing the pad 28 around the folded sleeping bag 12. Preferably, the first and second securing segments 61, 63 each include at least one, preferably two or more, connectable straps 65. The first securing segment 61 may include two connectable straps 65, as shown, that are fixedly attached to the lid section 48 of the pad 28 and to the third and fourth flaps 40, 42 respectively, of the middle section 32. The second securing segment 63 may include three connectable straps 65, as shown, that are fixedly attached to the first and second flaps 36, 38 respectively, of the upper section 30 of the pad 28. It should be noted that preferably all the connectable straps 65 are length adjustable to allow for varying amounts and/or sizes of articles to be stored within the sleeping bag 12 and held securely within the backpack shell 70. It should also be noted that when the sleeping apparatus 10 is in the sleeping configuration, the securing means 62, including all the connectable straps 65, can be unfastened and extended beyond the pad 28. In this way, the securing means 62 does not lay beneath the pad 28, creating uncomfortable lumps for the user.

Figure 9:
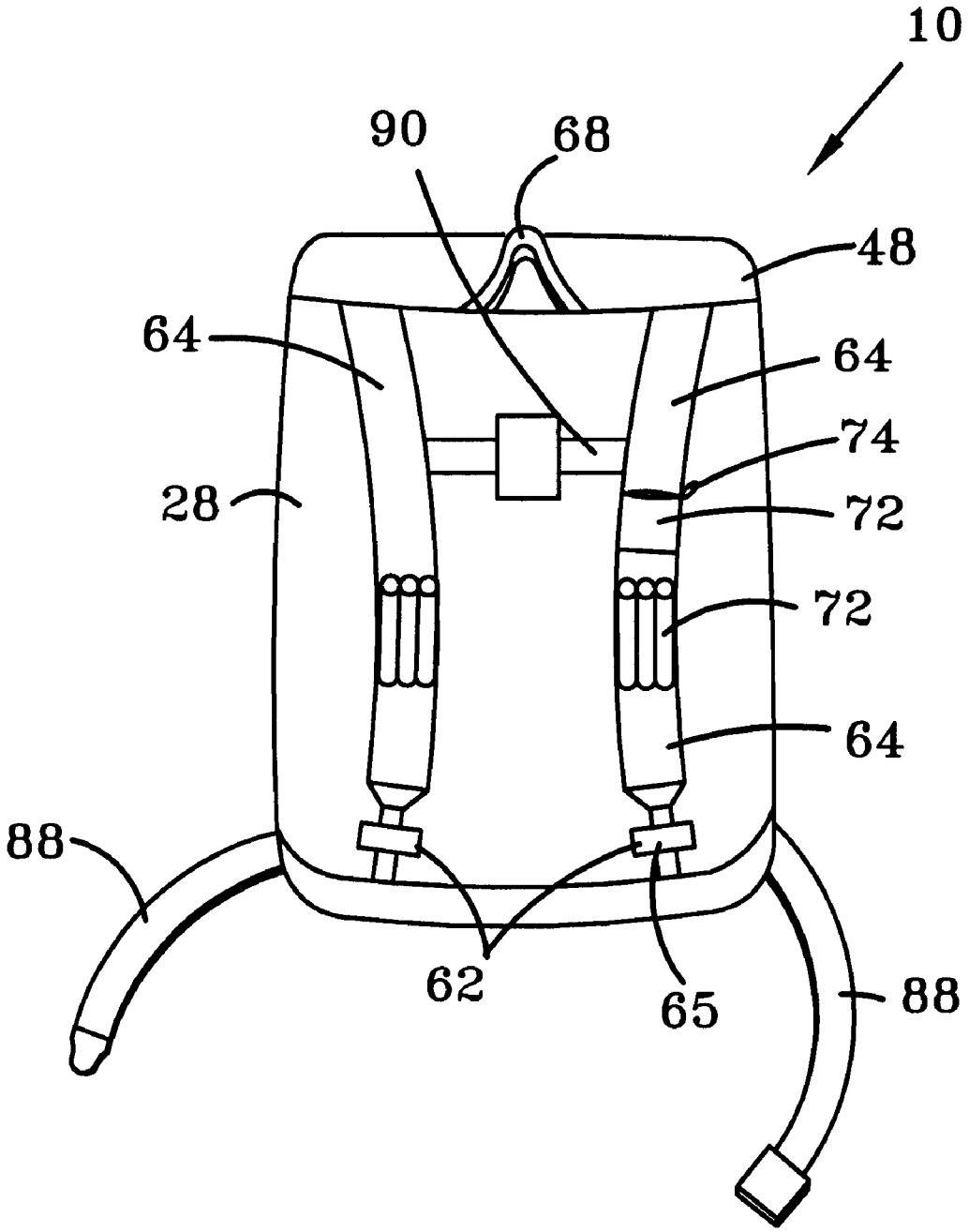
FIG. 9 is a front view of the inventive sleeping apparatus shown in the folded backpack configuration.

With reference now to FIGS. 7–9, the sleeping apparatus 10 preferably also has carrying means, such as a pair of shoulder straps 64, for use in carrying the sleeping apparatus 10 when in the backpack configuration. The shoulder straps 64 can be of any type chosen with sound engineering judgment but are preferably length adjustable, connectable straps having cushioned regions as shown. Preferably the shoulder straps 64 are fixedly attached to the upper section 30 of the pad 28. Optionally, an additional handle 68 may be attached to any appropriate portion of the pad 28. It should be noted that when the sleeping apparatus 10 is in the sleeping configuration, the shoulder straps 64 are unfastened and are positioned above the lid section 48 so that they do not lay beneath the pad 28, to avoid creating uncomfortable lumps for the user. It is also here contemplated that additional and optional straps, shown in FIG. 9, such as a waist strap 88 for use in wrapping around the waist of a user and/or a chest strap 90 for use in wrapping around the chest of a user may be attached to the pad 28. This further secures the sleeping apparatus 10 to the carrier.

With reference now to FIGS. 1–9, a method of converting the sleeping apparatus 10 from the sleeping configuration, shown in FIG. 1, to the backpack configuration, shown in FIG. 7, will now be discussed. First, the sleeping bag 12 is folded into the folded backpack configuration. It should be here noted that it is also well known to roll sleeping bags from a sleeping configuration to a storing or carrying configuration. Thus, when the terms "fold", "folded" and "folding" are used in this application, it is intended to include the act of rolling, packing, bundling, stuffing, or any method of changing the dimensions of the bag into the backpack configuration. Folding the sleeping bag 12 preferably includes the steps of folding the first width zone 76 onto the middle width zone 78 and then folding the second width zone 80 onto the middle and first width zones 78, 76. This is the condition shown in FIG. 2. Each of the width zones 76, 78, 80 are approximately equal in width to one third of the overall width of the sleeping bag 12. It should be noted that the folding of the first and second width zones 76, 80 are performed without causing the pad 28 to fold. Folding the sleeping bag 12 then includes the steps of folding the bottom portion 18 onto the middle portion 16. It should be noted that when this step is carried out, the pad 28 is not folded. Folding the sleeping bag 12 then includes the step of folding both the middle and bottom portions 16, 18 of the sleeping bag 12 onto the top portion 14. This is the condition shown in FIG. 5. When this step is carried out, the pad 28 is also folded since the middle portion 16 of the sleeping bag 12 is attached to the pad 28. Each portion is approximately equal in length to one third of the overall length Lb of the sleeping bag 12.

Still referring to FIGS. 1–9, the next step in converting the sleeping apparatus 10 from the sleeping configuration to the backpack configuration is to fold the pad 28 around the folded sleeping bag 12 into the backpack configuration. When this step is performed, the pad 28 is formed into the backpack shell 70 that holds the folded sleeping bag 12 within. This step preferably includes the step of folding the fifth and sixth flaps 44, 46 of the lower section 34 of the pad 28 over at least a portion of the first and third sides 58, 56 of the folded sleeping bag 12 respectively. Then, the third and fourth flaps 40, 42 of the middle section 32 are folded over at least a portion of the fifth and sixth flaps 44, 46 of the lower section 34 as well as over at least a portion of the first and third sides 58, 56 of the folded sleeping bag 12 respectively. This is the condition shown in FIG. 5. As noted above, this invention also works quite well if, alternatively, the third and fourth flaps 40, 42 of the middle section 32 are first folded over at least a portion of the first and third sides 58, 56 of the folded sleeping bag 12 respectively and then the fifth and sixth flaps 44, 46 of the lower section 34 are folded over the third and fourth flaps 40, 42 of the middle section 32 as well as over at least a portion of the first and third sides 58, 56 of the folded sleeping bag 12 respectively. Next, the first and second flaps 36, 38 of the upper section 30 are folded over at least a portion of the third and fourth flaps 40, 42 of the middle section 32 respectively, at least a portion of the fifth and sixth flaps 44, 46 of the lower section 34 respectively, and at least a portion of the first and third sides 58, 56 of the folded sleeping bag 12 respectively. This is the condition shown in FIG. 6 except for the securing means 62. When the lid section 48 is used, the folding of the pad 28 also includes the step of folding the lid section 48 over at least a portion of the first end 50 of the folded sleeping bag 12. This is the condition shown in FIG. 7 except for the securing means 62. Also as shown in FIG. 7, the lid section 48 preferably also covers at least a portion of the forth side 60 of the folded sleeping bag 12.

With continuing reference to FIGS. 1–9, the final step in converting the sleeping apparatus 10 from the sleeping configuration to the backpack configuration is to secure the pad 28 into the backpack configuration. This step preferably includes the step of connecting the first flap 36 of the upper section 30 to the second flap 38 of the upper section 30. Most preferably this includes fastening the three connectable straps 65 that are fixedly attached to the first and second flaps 36, 38 respectively. This is the condition shown in FIG. 6. Securing the pad 28 next includes the step of connecting the lid section 48 to the middle section 32. Most preferably this includes fastening the two connectable straps 65 that are fixedly attached to the lid section 48 and the middle section 32. This is the condition shown in FIG. 7. At this point, the sleeping apparatus 10 is fully converted into the backpack configuration and is suitable to be carried.

With reference again to FIGS. 1–9, a method of converting the sleeping apparatus 10 from the backpack configuration, shown in FIG. 7, to the sleeping configuration, shown in FIG. 1, will now be discussed. This conversion is primarily the reverse of the method disclosed above. First, the pad 28 is un-secured from the folded backpack configuration. Preferably this includes the steps of disconnecting the three connectable straps 65 that are fixedly attached to the first and second flaps 36, 38 respectively, and disconnecting the two connectable straps 65 that are fixedly attached to the lid section 48 and the middle section 32. This is the condition shown in FIG. 5. Then, the middle and bottom portions 16, 18 of the sleeping bag 12 are unfolded off of the top portion 14. This causes the middle and lower sections 32, 34 of the pad 28 to unfold into the planar shape shown in FIG. 1. Next, the bottom portion 18 of the sleeping bag 12 is unfolded off of the middle portion 16 without unfolding the pad 28 since the pad 28 is already fully unfolded. This is the condition shown in FIG. 2. The second width zone 80 of the sleeping bag 12 is then unfolded off of the middle and first width zones 78, 76. Finally, the first width zone 76 is unfolded off of the middle width zone 78. The unfolding of the width zones also occurs without unfolding the pad 12 since the pad 28 is already fully unfolded. This is the condition shown in FIG. 1. At this point, the sleeping apparatus 10 is fully converted into the sleeping configuration.

It should again be noted that a user of the present invention may place clothes or other items in the sleeping bag 12 before the sleeping bag 12 is folded. Such other items may also be placed outside the sleeping bag 12 but within the backpack shell 70. Thus, the present invention combines a sleeping bag 12 and a pad 28 into a sleeping apparatus 10 that is convertible into a backpack. Simplicity and efficiency are encouraged through this combination of components into a single, integral apparatus that is compact, light-weighted and multifunctional.

The preferred embodiments have been described, hereinabove. It will be apparent to those skilled in the art that the above apparatus and methods may incorporate changes and modifications without departing from the general scope of this invention. It is intended to include all such modifications and alterations in so far as they come within the scope of the appended claims or the equivalents thereof. For example, additional compartments similar to the compartment 72 disclosed above could be added at various places such as shown in FIG. 9.

Having thus described the invention, it is now claimed:

What is claimed is:

1. A method of converting a sleeping apparatus from a sleeping configuration to a backpack configuration, the sleeping apparatus including a sleeping bag having front and back sides and a pad operatively connected to said back side of said sleeping bag, the sleeping bag when in the unfolded sleeping configuration having top, middle and bottom portions, the method comprising the steps of:

folding the bottom portion of the sleeping bag onto the middle portion of the sleeping bag;

folding the middle and bottom portions of the sleeping bag onto the top portion of the sleeping bag;

folding the pad into a folded backpack configuration around the folded sleeping bag thereby forming the pad into a backpack shell that holds the sleeping bag within; and, securing the pad into the folded backpack configuration.

2. The method of claim 1 wherein the sleeping bag when in the unfolded sleeping configuration has first, middle and second width zones, before the step of folding the bottom portion of the sleeping bag onto the middle portion of the sleeping bag without folding the pad, the method comprises the steps of:

folding the first width zone of the sleeping bag onto the middle width zone of the sleeping bag without folding the pad; and, folding the second width zone of the sleeping bag onto the middle and first width zones of the sleeping bag without folding the pad.

3. The method of claim 1 wherein the sleeping bag when in the folded backpack configuration forms first and second ends and first, second, third and forth sides, the pad having upper, middle and lower sections, each with first and second flaps, the step of folding the pad into a folded backpack configuration around the folded sleeping bag thereby forming the pad into a backpack shell that holds the sleeping bag within, comprising the steps of:

folding the first and second flaps of the lower section of the pad over at least a portion of the first and third sides of the folded sleeping bag respectively;

folding the first and second flaps of the middle section of the pad over at least a portion of the first and second flaps of the lower section of the pad respectively as well as over at least a portion of the first and third sides of the folded sleeping bag respectively; and, folding the first and second flaps of the upper section of the pad over at least a portion of the first and second flaps of the middle and lower sections of the pad respectively as well as over at least a portion of the first and third sides of the folded sleeping bag respectively.

4. The method of claim 3 wherein the pad also includes a lid section operatively connected to said upper section of the pad, the step of folding the pad into a folded backpack configuration around the folded sleeping bag thereby forming the pad into a backpack shell that holds the sleeping bag within, further comprises the step of:

folding the lid section of the pad over at least a portion of the first end of the folded sleeping bag.

5. The method of claim 1, wherein the sleeping bag when in the backpack configuration forms first and second ends and first, second, third and forth sides, the pad having an upper section with first and second flaps that when in the backpack configuration covers at least a portion of the first, second and third sides of the sleeping bag, the step of securing the pad into the folded backpack configuration comprising the step of:

connecting the first flap of the upper section of the pad to the second flap across the forth side of the sleeping bag.

6. The method of claim 5 wherein a lid section is operatively connected to the upper section of the pad and covers at least a portion of the first end of the sleeping bag, the pad also having a middle section that covers at least a portion of the second end of the sleeping bag, after the step of connecting the first flap of the upper section of the pad to the second flap across the forth side of the sleeping bag, the method comprises the step of:

connecting the lid section to the middle section of the pad across the forth side of the sleeping bag.

7. A method of converting a sleeping apparatus from a backpack configuration to a sleeping configuration, the sleeping apparatus including a sleeping bag having front and back sides and a pad operatively connected to said back side of said sleeping bag, the sleeping bag when in the sleeping configuration having top, middle and bottom portions and first, middle and second width zones, the method comprising the steps of:

un-securing the pad from the folded backpack configuration;

unfolding the middle and bottom portions of the sleeping bag off of the top portion of the sleeping bag;

unfolding the bottom portion of the sleeping bag off of the middle portion of the sleeping bag;

unfolding the second width zone of the sleeping bag off of the middle and first width zones of the sleeping bag; and, unfolding the first width zone of the sleeping bag off of the middle width zone of the sleeping bag.

* * * * *